US006155933A

United States Patent [19]

Schmitt

[11] Patent Number: 6,155,933

[45] Date of Patent: Dec. 5, 2000

[54] GOLF PUTTER WITH SPHERICALLY CURVED CLUB HEAD

[76] Inventor: Hans A. Schmitt, 5573 County Rd. 168, West Liberty, Ohio 43357

[21] Appl. No.: 09/506,404

[22] Filed: Feb. 17, 2000

[51] Int. Cl.[7] ..... A63B 53/04

[52] U.S. Cl. ..... 473/330; 473/340

[58] Field of Search ..... 473/324, 330, 473/331, 340, 341, 342

[56] References Cited

U.S. PATENT DOCUMENTS

| | | |
|---|---|---|
| 1,525,137 | 2/1925 | Lawton . |
| 2,023,885 | 12/1935 | Hinckley . |
| 2,665,909 | 1/1954 | Wilson . |
| 3,637,218 | 1/1972 | Carlino . |
| 3,759,527 | 9/1973 | Witherspoon . |
| 3,989,257 | 11/1976 | Barr . |
| 5,213,332 | 5/1993 | Fahy et al. . |
| 5,303,923 | 4/1994 | Garcia . |
| 5,310,185 | 5/1994 | Viollaz et al. . |
| 5,333,873 | 8/1994 | Burke . |
| 5,382,019 | 1/1995 | Sneed . |
| 5,460,375 | 10/1995 | Hardee . |
| 5,718,644 | 2/1998 | Donofrio . |
| 5,857,922 | 1/1999 | Delio . |
| 5,863,262 | 1/1999 | Donofrio . |

*Primary Examiner*—Sebastiano Passaniti
*Attorney, Agent, or Firm*—Mark A. Navarre

[57] ABSTRACT

An improved putter in which the frontal surface of the club head is curved both horizontally and vertically, with the frontal surface being defined by a portion of a sphere centered behind the club head and below a bottom face of the club head. The horizontal curvature of the frontal surface compensates for horizontal inclination of the club head with respect to the intended line of travel of the golf ball, and the vertical curvature of the frontal surface provides a consistent degree of loft despite variations in vertical inclination of the club head.

3 Claims, 2 Drawing Sheets

GOLF PUTTER WITH SPHERICALLY CURVED CLUB HEAD

TECHNICAL FIELD

This invention relates to golf putters, and more particularly to a putter having a club head shaped to compensate for putter stroke variations.

BACKGROUND OF THE INVENTION

When putting a golf ball, the most accurate and consistent results are achieved when the stroke of putter club head coincides with an intended line of travel of the golf ball, and the frontal surface of the club head is maintained perpendicular to the intended line of travel. This is because the point of impact between the putter and the golf ball determines the actual line of travel of the golf ball, neglecting variations in putting green slope.

Most experienced golfers are able to keep the stroke more or less in coincidence with the intended line of travel, but many have difficulty maintaining the club head perpendicular to the line of travel. A club head that is horizontally inclined toward the golfer on impact with the golf ball is said to be "closed", while a club head that is horizontally inclined away from the golfer on impact with the golf ball is said to be "opened". When the frontal surface of a putter club head is flat (as is usually the case), closing the club head moves the point of impact away from the golfer, while opening the club head moves the point of impact toward the golfer. Thus, closing the club head causes the ball to go left of the intended line of travel, while opening the club head causes the ball to go right of the intended line of travel. In the case of a 10-foot putt, for example, opening or closing the club head by only 3.0 degrees causes the ball to miss the center of the hole by 6.3 inches.

Others have recognized the above-described problem, and various club head configurations have been proposed to compensate for stroke variations. See, for example, the U.S. Pat. Nos. 3,989,257 to Barr; 4,121,833 to Prueter; and 5,213,332 to Fahy et al. These patents each propose the use of a curved club head that tends to mitigate the effect of opening and closing.

Another problem experienced by golfer occurs due to variations in the vertical angle of the club head when the putter strikes the golf ball. This may be due to variations in the position of the golfer's hands or feet relative to the ball. The frontal surface of a putter club head is customarily angled with respect to the vertical to impart a certain amount of loft to the golf ball, but the degree of loft actually achieved changes with the above-described variations, making it difficult for the golfer to putt consistently.

Accordingly, what is needed is a putter that compensates for a variety of stroke anomalies, enabling the golfer to putt more accurately and consistently in spite of the anomalies.

SUMMARY OF THE INVENTION

The present invention is directed to an improved putter in which the frontal surface of the club head is curved both horizontally and vertically, with the frontal surface being defined by a portion of a sphere centered behind the club head and below a bottom face of the club head. The horizontal curvature of the frontal surface compensates for horizontal inclination of the club head with respect to the intended line of travel of the golf ball, and the vertical curvature of the frontal surface provides a consistent degree of loft despite variations in vertical inclination of the club head.

DESCRIPTION OF THE PREFERRED EMBODIMENT

Figure 1:
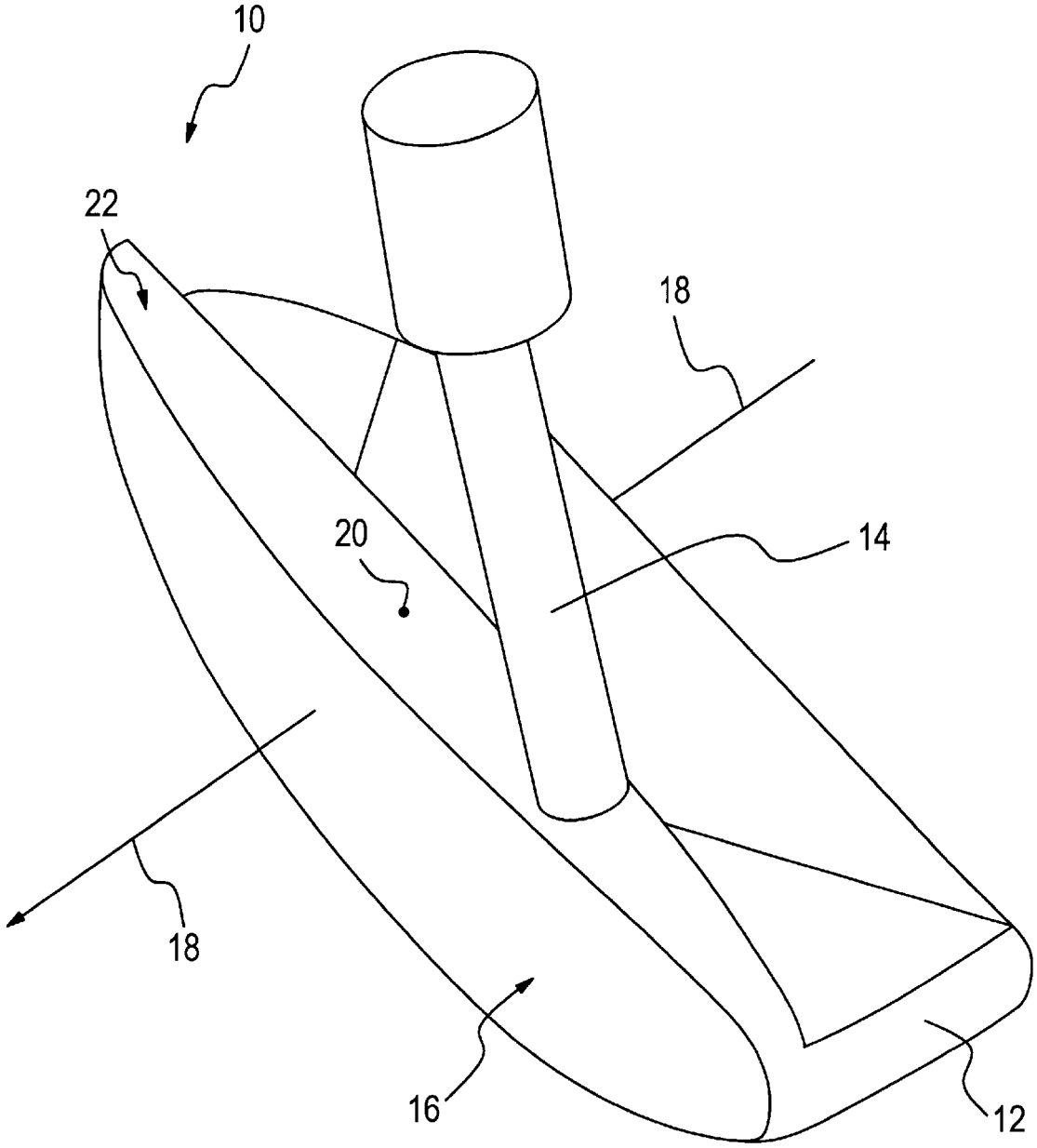
FIG. 1 is an isometric view of a golf putter according to this invention.

Referring to the drawings, and particularly to FIG. 1, the reference numeral 10 generally designates a portion of a golf putter, including a club head 12 and an attached shaft 14 that has been truncated for ease of illustration. The club head 12 has a frontal face 16 that is adapted to be brought into contact with a golf ball (not shown) as the putter 10 is stroked along an intended line of golf ball travel, indicated by the line 18. An indicator 20 located on an upper face 22 of the club head 12 is utilized by the golfer to position the putter 10 so that the intended line of travel 18 will pass approximately through the center of gravity of the club head 12.

According to this invention, the frontal face 16 of putter 10 is curved in a way that compensates for variations in horizontal inclination of the club head 12 with respect to the intended line of travel 18 and vertical inclination of the club head 12 with respect to a plane perpendicular to the line of travel 18. Specifically, the frontal face 16 is curved both horizontally and vertically, with the frontal surface being defined by a portion of a sphere centered behind the club head 12 and below a bottom face 26 of the club head. The horizontal curvature compensates for horizontal inclination of the club head 12 by maintaining the horizontal point of impact on the golf ball substantially constant in spite of the horizontal inclination, and similarly, the vertical curvature compensates for vertical inclination of the club head 12 by maintaining the vertical point of impact on the golf ball substantially constant in spite of the vertical inclination. As a result, the golf ball will follow the intended line of travel 18 despite variations in horizontal inclination, and the putter 10 will impart a consistent degree of loft to the golf ball despite variations in vertical inclination.

Figure 2:
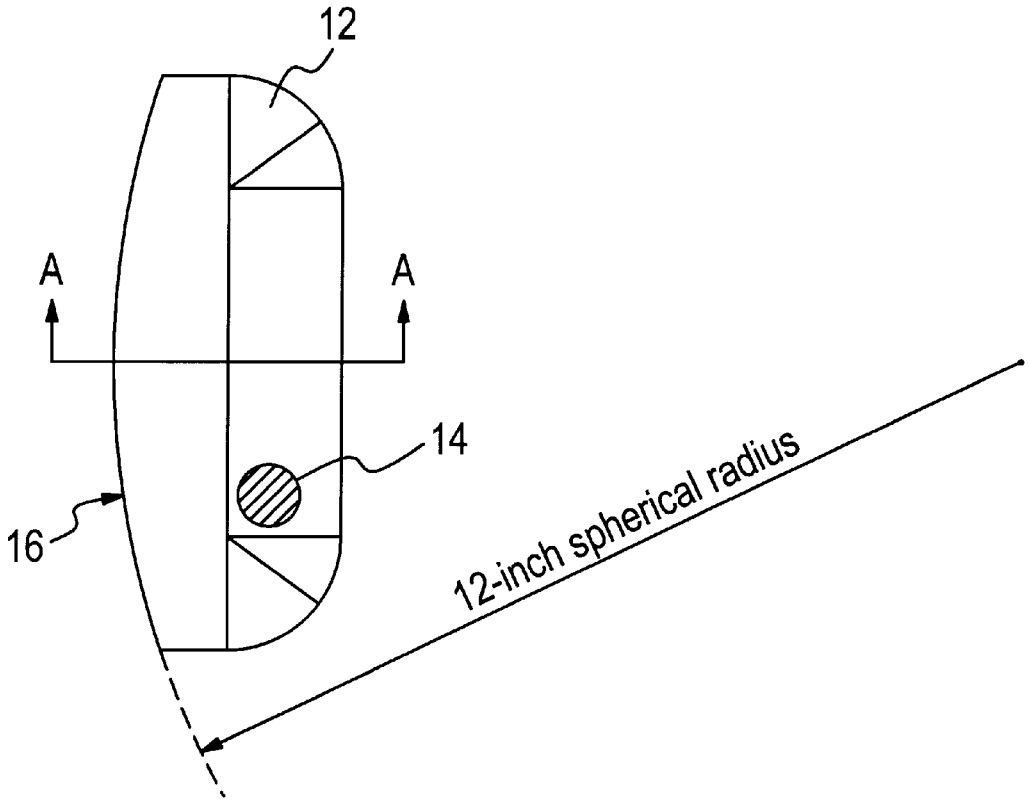
FIG. 2 is top view of the putter of FIG. 1.
Figure 3:
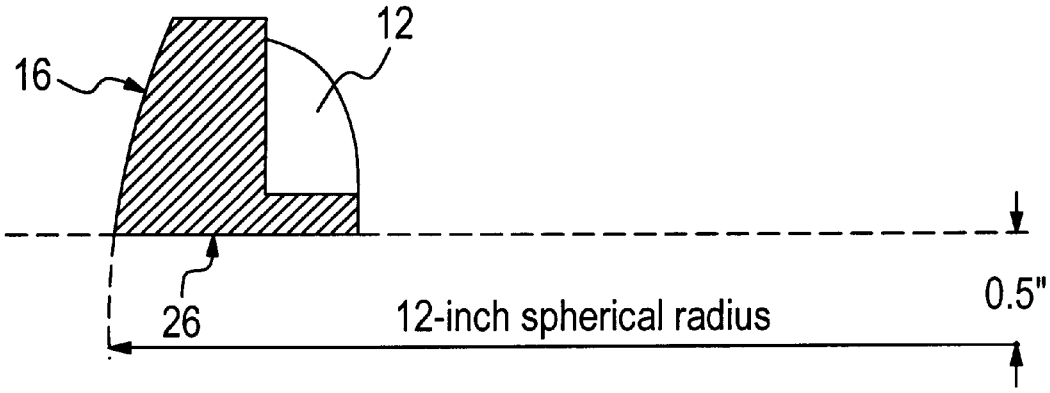
FIG. 3 is a cross-sectional view of the putter of FIG. 2, taken along lines A—A.

In a preferred implementation of this invention, the frontal surface 16 of the club head 12 is defined by a portion of a sphere having a radius of approximately 12 inches and centered behind and below the club head 12, as illustrated in FIGS. 2 and 3. FIG. 2 shows a top view of the putter 10, and illustrates the horizontal curvature of frontal surface 16; FIG. 3 shows a cross-section of the club head 12 taken along lines A—A in FIG. 2, and illustrates the vertical curvature of frontal face 16. In the preferred embodiment, the sphere defining the frontal surface curvature is centered approximately 12 inches behind the frontal surface 16, and 0.5 inches below the bottom surface 26, as shown.

In summary, the putter of this invention automatically compensates for minor variations in horizontal and vertical inclination of the club head, yielding a more consistent putt. While described in reference to the illustrated embodiment, it is expected that various modifications will occur to those skilled in the art. For example, similar results may be obtained if the spherical radius is changed somewhat; while the indicated radius of 12-inches is deemed to provide optimal results, the invention may be beneficially practiced with spherical radii in the range of 10–20 inches. Similarly, the downward displacement of the center of the sphere may be varied somewhat, depending on the degree of loft that is desired. Accordingly, it will be understood that putters incorporating these and other modifications may fall within the scope of this invention, which is defined by the appended claims.

What is claimed is:

1. A golf putter including a club head coupled to a shaft and adapted to be stroked along an intended line of travel of a golf ball, the club head having a frontal face that contacts the golf ball as the club head is stroked, the improvement wherein:

the frontal face of the club head is defined by a portion of a sphere centered behind the club head and below a bottom face of the club head, where the horizontal curvature compensates for horizontal inclination of the club head with respect to the intended line of travel, and the vertical curvature provides a consistent degree of loft to the golf ball despite variations in vertical inclination of the club head.

2. The golf putter of claim 1, where the sphere is centered approximately 12 inches behind said frontal face.

3. The golf putter of claim 1, where the sphere is centered approximately 12 inches behind said frontal face, and 0.5 inch below said bottom face.

* * * * *